US006588514B2

(12) United States Patent
Kozak

(10) Patent No.: US 6,588,514 B2
(45) Date of Patent: Jul. 8, 2003

(54) METHOD AND APPARATUS FOR SINGLE HANDED DRIVING OF ELONGATED RODS OR STAKES

(76) Inventor: David A. Kozak, 120 W. 8th St., Pennsburg, PA (US) 18073

( * ) Notice: Subject to any disclaimer, the term of this patent is extended or adjusted under 35 U.S.C. 154(b) by 67 days.

(21) Appl. No.: 09/812,496

(22) Filed: Mar. 20, 2001

(65) Prior Publication Data

US 2002/0134561 A1 Sep. 26, 2002

(51) Int. Cl.[7] ..... E21B 7/20
(52) U.S. Cl. ..... 173/1; 173/90; 173/132
(58) Field of Search ..... 227/113, 119, 227/142, 147; 173/1, 90, 132; 279/89; 81/124.4

(56) References Cited

U.S. PATENT DOCUMENTS

| | | | | | |
|---|---|---|---|---|---|
| 924,054 | A | * | 6/1909 | Gehne | 227/147 |
| 2,475,936 | A | * | 7/1949 | Allen | 173/202 |
| 2,543,942 | A | * | 3/1951 | Shaff | 227/147 |
| 3,042,004 | A | * | 7/1962 | Fischer et al. | 173/133 |
| 3,117,378 | A | * | 1/1964 | Bowen | 173/90 |
| 3,228,269 | A | * | 1/1966 | Heyer | 29/275 |
| 3,449,988 | A | * | 6/1969 | Gallo, Sr. | 227/147 |
| 4,557,409 | A | | 12/1985 | Hecock et al. | |
| 4,627,563 | A | | 12/1986 | Meyer | |
| 4,676,424 | A | | 6/1987 | Meador et al. | |
| 4,901,712 | A | * | 2/1990 | Voegell et al. | 227/147 |
| 5,335,569 | A | * | 8/1994 | Rowley | 81/125 |
| 5,337,836 | A | * | 8/1994 | Williams | 173/90 |
| 5,529,234 | A | | 6/1996 | Juneau | |
| 5,605,271 | A | | 2/1997 | Russell | |
| 5,875,950 | A | | 3/1999 | Nuss et al. | |
| 6,036,073 | A | | 3/2000 | Newhouse | |

* cited by examiner

*Primary Examiner*—Scott A. Smith
*Assistant Examiner*—Nathaniel Chukwurah
(74) *Attorney, Agent, or Firm*—RatnerPrestia

(57) ABSTRACT

A method and apparatus permitting a single operator to drive elongated rods, e.g. tent stakes, into the ground for securing lines, ropes, cables and the like. The apparatus is a holder for the rod or stake that is fixed to the driving end of a pneumatic hammer. A longitudinal slot in the apparatus permits positioning of the rod so that the operator can raise the pneumatic hammer and rod into a generally vertical position and by activating the pneumatic hammer drive the rod into a fixed position. Thereafter the pneumatic hammer and holder can be readily removed from the driven rod.

10 Claims, 5 Drawing Sheets

METHOD AND APPARATUS FOR SINGLE HANDED DRIVING OF ELONGATED RODS OR STAKES

BACKGROUND OF THE INVENTION

The present invention pertains to a method and apparatus for driving elongated rods such as tent stakes into the ground in order to provide a secure anchor for a rope, cable, chain or other ground tying device.

During the erection of a tent a series of rods or stakes must be driven proximate the perimeter of the tent so that tent ropes can be fastened to a stationary device to support the tent roof or canopy by, in essence, stretching the tent roof or canopy across main tent stakes and side poles, the side poles positioned by tent ropes which in turn are fastened to the stakes or rods.

In erecting large tents for outdoor functions such as a wedding receptions, it is necessary to use stakes that are about three feet in length. One method of driving the stake into the ground is to use a sledge hammer with one person holding the stake while one or more helpers drive the stake into the ground. The persons driving the stake can use a hand sledge hammer or use a pneumatic hammer fitted with a stake driving is tool. The use of the pneumatic or "jack" hammer requires at least two persons and sometimes three people to drive the stakes. When using such a device, one person has to position and start the stake while, depending upon size of the pneumatic hammer, it can take up to two men to operate the pneumatic hammer to drive the stake into its final position.

U.S. Pat. No. 4,627,563 is illustrative of a jack hammer and accessory device for driving U-shaped anchors into the ground.

U.S. Pat. No. 4,557,409 illustrates a device for driving an electrical grounding rod into the earth using a slide hammer.

U.S. Pat. Nos. 4,676,424, 5,529,234, 5,605,271, 5,875,950 and 6,036,073 are illustrative of devices used to position nails for driving using a sliding hammer, which engages the nail and which is actuated by a hand held hammer or a pneumatic device.

BRIEF SUMMARY OF THE INVENTION

The present invention pertains to a method and apparatus that would permit a single operator to drive an elongated rod or tent stake into the ground using a pneumatic hammer. The apparatus according to the invention is an adapter that is fitted to the pneumatic hammer, the adapter having an elongated slot into which the rod or stake is placed and positioned for being driven by the pneumatic hammer. A single operator can position the stake in the holder according to the invention, then raise the holder and jack hammer into position and finally actuate the hammer to drive the stake into the ground.

Thus, according to one aspect the present invention is a device for positioning an elongated rod to be driven into a surface, the rod used to secure an object in a desired location comprising; a first generally cylindrical portion extending from a first end of said device toward a transition portion having the shape of a truncated cone, a smaller end of the transition portion being a second end of the cylindrical portion and a larger end of the transition portion being a first end of a second generally cylindrical portion larger in diameter than the first generally cylindrical portion; a generally cylindrical bore extending from a second end of the second cylindrical portion toward and partially into the transition portion, a passage having a generally U-shaped cross-section extending from a first end of the first cylindrical portion into the transition portion, and a transverse aperture having a cross-sectional shape of a rectangle with rounded ends extending from an outer surface of the transition portion into the device to make a connecting passage between the cylindrical bore and the passage having the generally U-shaped cross-section.

In another aspect the present invention is a method for single handedly driving a tent stake into the ground using a pneumatic hammer by first fitting the pneumatic hammer with a device for driving an elongated rod into a surface, the rod used to secure an object in a desired location, comprising; a first generally cylindrical portion extending from a first end of the device toward a transition portion having the shape of a truncated cone, a smaller end of the transition portion being a second end of the first cylindrical portion and a larger end of the transition portion being a first end of a generally elongated second cylindrical portion larger in diameter than the first generally cylindrical portion, a generally cylindrical bore extending from a second end of the second cylindrical portion toward and partially into the transition portion; a passage having a generally U-shaped cross-section extending from a first end of the first cylindrical portion, with a transverse aperture having a cross-sectional shape of a rectangle with rounded ends extending from an outer surface of the transition portion into the device to make a connecting passage between the cylindrical bore and the passage having the generally U-shaped cross-section, and, thereafter positioning a tent stake inside the generally U-shaped passage, raising the stake and pneumatic hammer and actuating the pneumatic hammer to drive the stake.

DETAILED DESCRIPTION OF THE INVENTION

Figure 1:
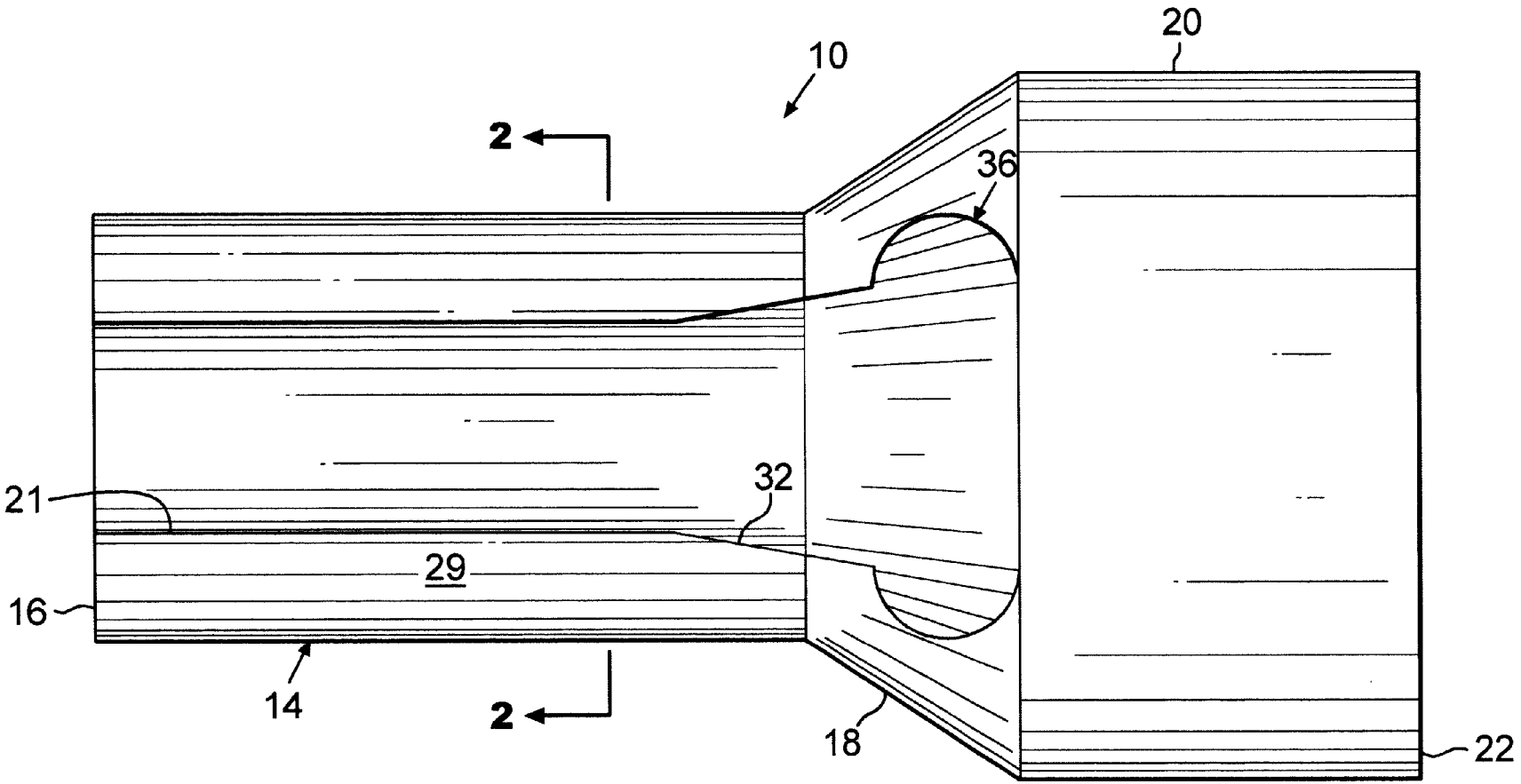
FIG. 1 is a front elevational view of the device according to the present invention.
Figure 2:
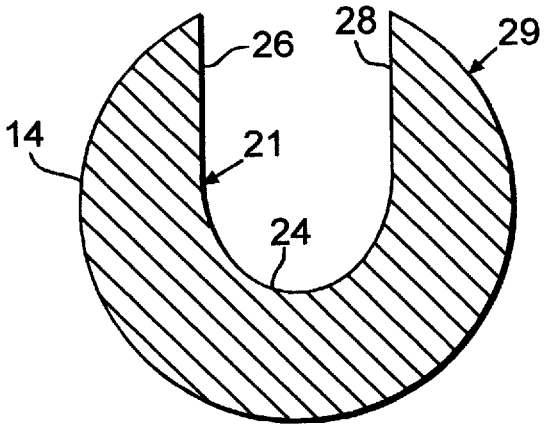
FIG. 2 is a section taken along line 2—2 of FIG. 1.
Figure 4:
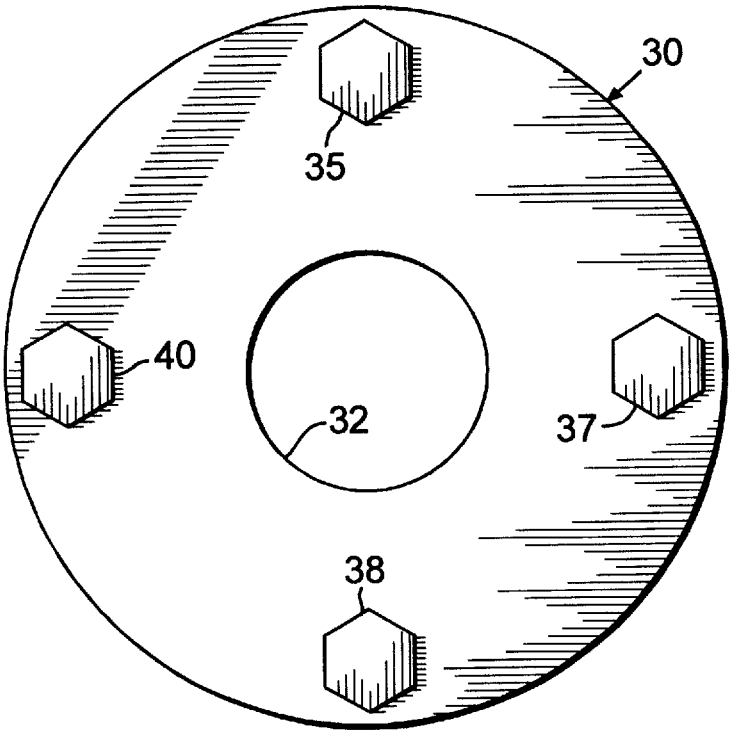
FIG. 4 is an end view of the right end of the device of FIG. 3.
Figure 3:
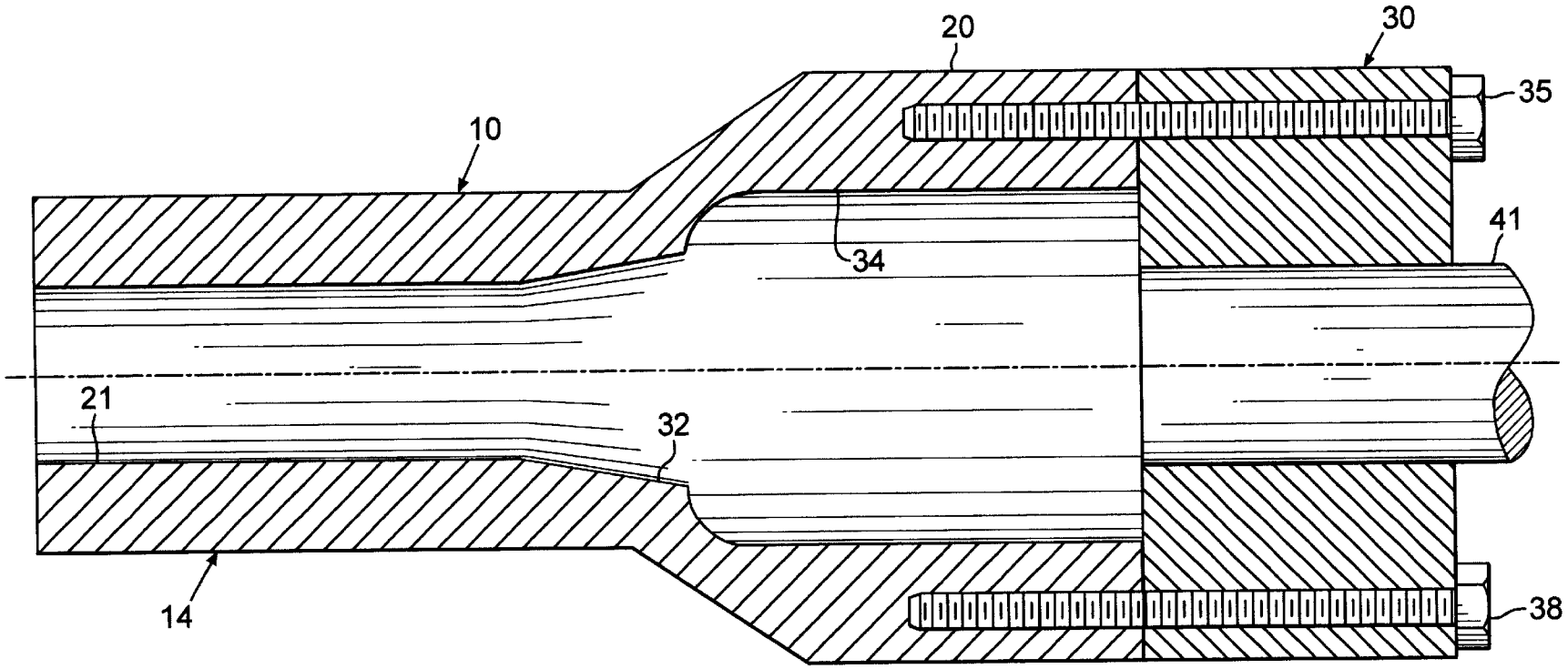
FIG. 3 is a longitudinal section of the apparatus of FIG. 1 mated to a hammer portion used to actually drive the stake.

Referring to FIG. 1 the positioning device according to the present invention is shown generally as 10. The device 10 has a first generally cylindrical portion 14 which extends from a first end 16 to a transition portion 18. The transition portion 18 has the general shape of a truncated cone. Transition portion 18 tapers outwardly and terminates at a second cylindrical portion 20 of the device 10, second cylindrical portion 20 having the shape of a cylinder terminating in a second end 22 of the device 10. The first cylindrical portion 14 has a generally U-shaped slot 21, which is shown more clearly in FIG. 2. Slot 21 has a bottom portion 24 which is generally semi-circular in shape mating with vertical walls 26, 28 which open onto the outer surface 30 of cylindrical portion 14. As shown in FIG. 1 the slot 21 extends from the first end 16 of device 10 toward and into the transition portion 18. The upper portion 32 of slot 21 has a generally outwardly tapered portion shown more clearly in FIG. 3. The outwardly tapered portion 32 terminates in a larger diameter portion 34, which extends to the surface 22 of device 10. A transverse slot 36, having the cross-sectional shape of a rectangle with rounded ends, in transition portion 18 facilitates positioning of rods or stakes with mushroomed heads into the device 10 for being driven into the ground. As shown in FIG. 3 the curved transition between the larger diameter portion 34 and the upper tapered portion 32 of slot 21 created by transverse slot 36 results in a shoulder which will support rods with mushroomed heads. As shown in FIGS. 3 and 4, device 10 is mated to a driving device 30, which is in the shape of a cylinder having a diameter equal to second cylindrical portion 20 of apparatus 10. Referring to FIG. 4, driving portion 30 has a central bore 32 with a diameter approximating that of the cylindrical portion of slot 21. Driving device 30 is fixed to device 10 by a series of threaded bolts 35, 37, 38 and 40. An adapter 41 fits into aperture 32 to fix the holder 10 and the driving device 30 to a pneumatic hammer, as will hereinafter be more fully described.

Figure 5:
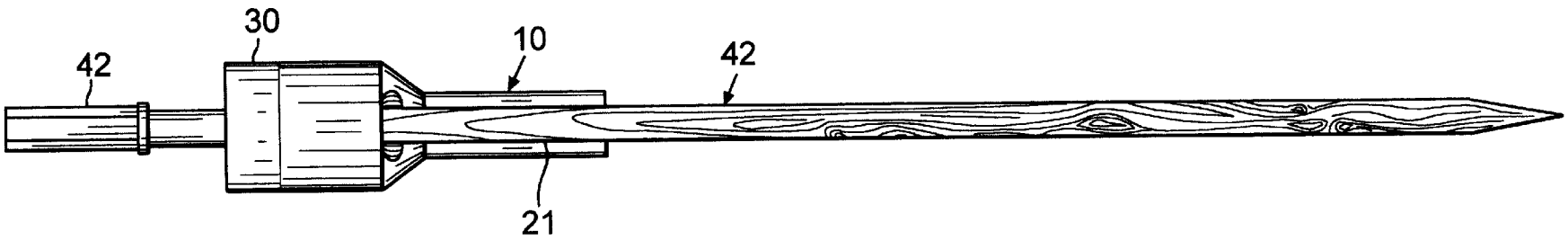
FIG. 5 is a front elevational view of the apparatus of the present invention with a stake in position for being driven.
Figure 6:
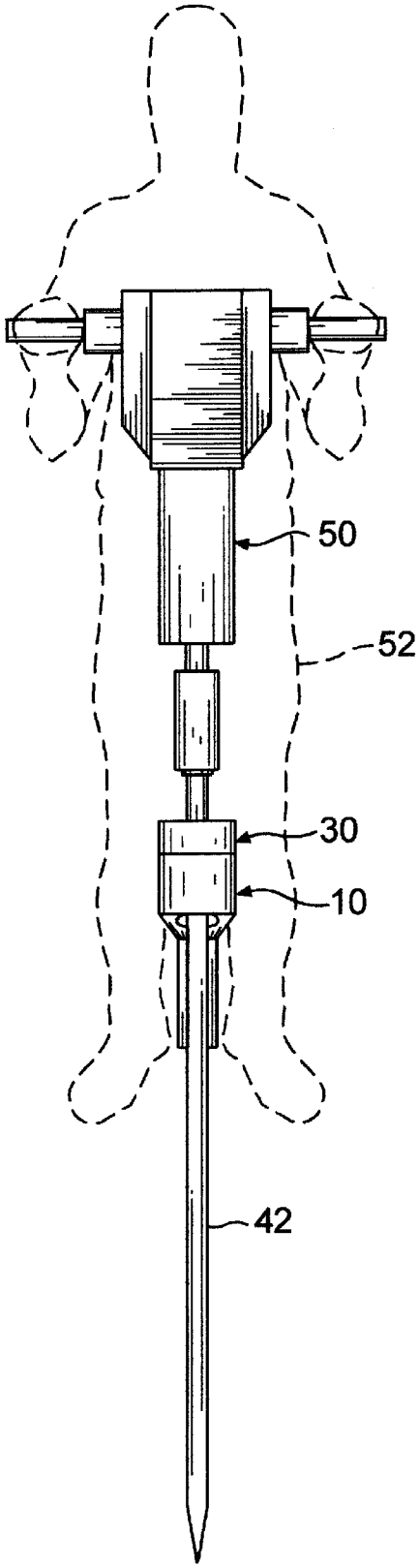
FIG. 6 is a schematic representation of an operator having the apparatus of the present invention positioned for performing the method of the present invention.

Referring to FIG. 5 the holder 10 and driving device 30 are fixed together and a rod or tent stake 42 is inserted into the slot 22 and pushed upwardly toward the driving portion 30. The adapter 41 is coupled to a pneumatic or jack hammer 50 shown in FIG. 6.

In operation a person wishing to erect a tent or drive a stake into the ground, positions the stake 42 in the holder 10 and driving device 30 as shown in FIG. 5. With the slot facing away from the operator, shown in dotted lines as 52 in FIG. 6, the operator would raise the stake 42 and pneumatic hammer 50 into a vertical position then actuate the pneumatic hammer to drive the stake into the ground. The stakes can be driven at a convenient angle as is well known to a worker skilled in erecting tents or positioning stakes to receive and secure ground lines, ropes, cables or the like.

The method and apparatus according to the invention can be used in any operation where there are rods or stakes to be located in a fixed position. The major benefit of the present invention is the ability of a single operator to drive stakes or rods into the ground using a pneumatic hammer without requiring assistance in positioning the stake in the location in which it is to be driven into the ground.

Having thus described my invention what is desired to be secured by Letters Patent of the United States is set forth in the appended claims.

What is claimed:

1. A device for driving an elongated tent stake into a surface, said tent stake used to secure an object in a desired location, comprising:

a first generally cylindrical portion extending from a first end of said device toward a transition portion having the shape of a truncated cone, a smaller end of said transition portion being a second end of said first cylindrical portion and a larger end of said transition portion being a first end of a generally elongated second cylindrical portion larger in diameter than said first generally cylindrical portion;

a generally cylindrical bore extending from a second end of said second cylindrical portion toward and partially into said transition portion;

a passage having a generally U-shaped cross-section extending from a first end of said first cylindrical portion into said transition portion;

a transverse aperture having a cross-sectional shape of a rectangle with rounded ends extending from an outer surface of said transition portion into said device to make a connecting passage between said cylindrical bore and said passage having said generally U-shaped cross-section in order to facilitate placing and positioning a tent stake with a mushroomed head into said device; and a second generally cylindrical shaped part having a diameter equal to that of the second cylindrical portion of the device with a longitudinal bore having a generally circular cross-sectional shape, said bore having a diameter generally equal to the cylindrical portion of the generally U-shaped passage of said device; and means to rigidly connect said second part to said device.

2. A device according to claim 1, wherein said second generally cylindrical part has a plurality of apertures spaced around said longitudinal bore and said first portion of said device has matching threaded aperture spaced around the cylindrical passage whereby said second part can be fixed to said device by suitably threaded bolts.

3. A device according to claim 2, wherein four equally spaced apertures and four matching apertures are in said second part and said device, said apertures in said device adapted to received and hold threaded bolts.

4. A device according to claim 3, wherein said second part is rigidly fixed to said device part by bolts.

5. A device according to claim 1, including an outwardly tapering portion of said passage with the generally U-shaped cross-section extending between said transverse aperture and said passage in said second cylindrical portion of said device.

6. A device according to claim 1, including means to attach said second part to a pneumatic hammer.

7. A device according to claim 1, wherein said rod is a tent stake.

8. A method for driving an elongated tent stake into a surface, said tent stake used to secure an object in a desired location, comprising the steps of:

installing a device comprising a first generally cylindrical portion extending from a first end of said device toward a transition portion having the shape of a truncated cone, a smaller end of said transition portion being a second end of said first cylindrical portion and a larger end of said transition portion being a first end of a generally elongated second cylindrical portion larger in diameter than said first generally cylindrical portion;

a generally cylindrical bore extending from a second end of said second cylindrical portion toward and partially into said transition portion;

a passage having a generally U-shaped cross-section extending from a first end of said first cylindrical portion into said transition portion;

a transverse aperture having a cross-sectional shape of a rectangle with rounded ends extending from an outer surface of said transition portion into said device to make a connecting passage between said cylindrical bore and said passage having said generally U-shaped cross-section to facilitate placing and positioning tent stakes with mushroomed heads into said device on a pneumatic hammer;

rigidly connecting a second generally cylindrical shaped part having a diameter equal to that of the second cylindrical portion of the device with a longitudinal bore having a generally circular cross-sectional shape, said bore having a diameter generally equal to the cylindrical portion of the generally U-shaped passage of said device to said device;

inserting said tent stake into said U-shaped passage;

raising said pneumatic hammer into a vertical position; and activating said pneumatic hammer to drive said tent stake into said surface.

9. A method according to claim 8, including the step of rigidly securing said second generally cylindrical shaped part to said pneumatic hammer.

10. A method according to claim 8, including the step of inserting a tent stake into said generally U-shaped passage.

* * * * *